United States Patent [19]

Liautaud

[11] 4,118,942

[45] Oct. 10, 1978

[54] MARINE PLATFORM FOR OFFSHORE DRILLING OPERATIONS AND THE LIKE

[76] Inventor: Jean Liautaud, 49 Avenue de Segur, Paris 75007, France

[21] Appl. No.: 732,812

[22] Filed: Oct. 15, 1976

[30] Foreign Application Priority Data

Nov. 17, 1975 [FR] France ..... 75 34950

[51] Int. Cl.[2] ..... E02B 17/00

[52] U.S. Cl. ..... 405/204; 405/227; 405/205

[58] Field of Search ..... 61/87, 88, 89, 92, 96, 61/97; 114/77 R, 65 R, 264, 265

[56] References Cited

U.S. PATENT DOCUMENTS

| | | | |
|---|---|---|---|
| 2,580,911 | 1/1952 | Harris | 61/97 |
| 2,775,095 | 12/1956 | Harris | 61/94 |
| 3,064,437 | 11/1962 | Knapp | 61/89 |
| 3,693,361 | 9/1972 | Koehler | 61/97 |
| 4,009,583 | 3/1977 | Buckle | 61/70 |

FOREIGN PATENT DOCUMENTS

| | | | |
|---|---|---|---|
| 1,386,327 | 3/1975 | United Kingdom | 61/97 |

*Primary Examiner*—Jacob Shapiro

*Attorney, Agent, or Firm*—Burgess, Ryan and Wayne

[57] ABSTRACT

A marine platform comprises a caisson unit adapted to be placed onto the submarine ground at a desired offshore site. A tower-like tubular structure comprising a plurality of columns extends vertically upwardly from said caisson unit and with their lower ends integrally fixed to said caisson unit. A deck unit adapted to be provided with petroleum drilling equipment or the like is integrally fixed to the upper ends of said columns. A floating unit is adapted to be displaceably and removably fixed to said columns.

5 Claims, 7 Drawing Figures

MARINE PLATFORM FOR OFFSHORE DRILLING OPERATIONS AND THE LIKE

The instant invention relates to a marine platform adapted to be installed for carrying out offshore submarine drilling operations or the like, e.g. for extracting petroleum from the submarine sub-soil.

A known platform of this kind comprises a caisson unit which constitutes the immersible base of the platform, adapted to be placed on the submarine ground, and a deck unit connected to said caisson unit by a plurality of hollow columns and equipped with the required installations, such as derricks, housing accomodations for the operators, etc.; in the known platform the deck unit is slidably mounted on said columns and adapted to be placed onto the caisson unit during the towing operation with a view to transporting the platform to the desired site at sea, whereby the center of gravity of the platform is located, during said towing operation, at a point substantially lower than it has been in prior platforms wherein the deck unit was fixedly mounted at the top of said columns. Furthermore, the known platform has to be constructed in comparatively deep waters, having a depth of at least 30m, which may correspond to the height of the caisson unit. Once the above described known platform has reached its desired site at sea, the caisson unit, which until then had been attached to the deck unit by clamping means is detached therefrom and then lowered until it reposes on the submarine ground, while the deck unit remains at the surface of the water where it floats until, after touch-down of the caisson unit, it is raised to a convenient height above the water surface by means of a hoisting device. In order to ensure a favourable behaviour of the platform during the lowering of the caisson unit and during the operation of raising the deck unit after touchdown of the caisson unit, the latter is connected to the deck unit by cables wound up on winches located on the deck unit, said cables being unwound in a convenient manner during said lowering and raising operations; these cables may be removed once the caisson unit and the deck unit have reached their respective final positions at the desired location at sea.

While this known platform allows of towing the entire assembly with its center of gravity located sufficiently low for ensuring a satisfactory stability, it is necessary to provide a comparatively complicated and costly mechanism for hoisting the very heavy deck unit after touch-down of the caisson unit, as described herein above.

Furthermore when it is desired to remove the above mentioned cables after the touch-down of the caisson unit and the raising of the deck unit, this removal involves fastidious operations.

Furthermore during the entire towing and caisson unit lowering operations the deck unit of this known platform is located in the vicinity of the water surface, thus exposing the equipment provided on said deck unit to the undesirable effects of the sea water which may easily splash over the deck unit and consequently impair said equipment, especially the winches.

The present invention is aimed at providing a platform of the kind described herein before, which is easier to construct and less costly than the known platform.

Another object of the invention is to provide a platform of the kind considered, which may be constructed in extremely shallow waters.

Still another object of the invention to provide a platform of the above mentioned kind wherein the equipment mounted on the deck unit is substantially not exposed to the deleterious effects of the sea water during the towing and caisson unit lowering operations.

The instant invention provides a platform of the kind considered herein above, wherein a floating unit is removably mounted onto the caisson unit and adapted to be withdrawn once the caisson unit has been lowered onto the submarine ground at the desired offshore site, said floating unit being adapted to be re-used.

Other objects and features of the invention will become apparent from the following description of a particular embodiment of the invention. The description refers to the appended drawings; it is not to be construed as limiting the scope of the invention to the said embodiment which is given by way of example only.

Figure 1:
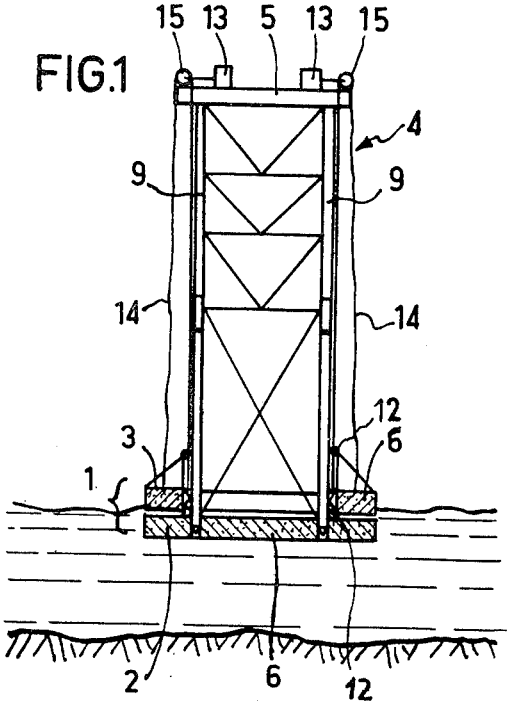
FIG. 1 is a schematical elevational view of a platform according to the invention, as completed on the construction site, the equipment of the deck unit being omitted with a view to simplifying the drawing.

As shown especially in FIG. 1, the platform according to the invention comprises a caisson unit 2 provided at the lowermost end of the platform, a floating unit 3 displaceably and removably mounted above caisson unit 2, a tower-like tubular structure 4 of a kind known per se which is integral with caisson unit 2, and a deck unit 5 adapted to be equipped with the material necessary e.g. for effecting drilling operations in the submarine subsoil with a view to extracting petroleum therefrom. Deck unit 5 is integral with the tubular structure 4 and located on the top end thereof.

Figure 2:
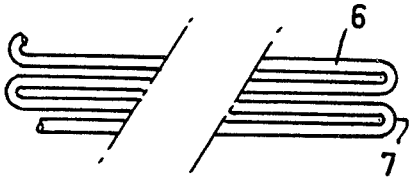
FIGS. 2 and 3 show two different arrangements of the tubes provided within the caisson and floating units.
Figure 3:
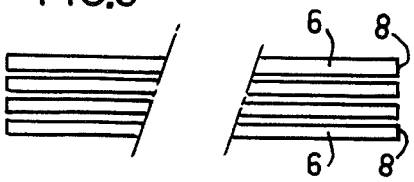

Floating unit 3 and caisson unit 2 are provided each with a plurality of parallel tubular elements 6 which may be interconnected, as shown in FIG. 2, by bent tubular portions so as to form a continuous serpentine-like tube, or which alternatively can be closed each at its two ends by sealing plates 8, as shown in FIG. 3. In both cases, means are provided for establishing a communication between the inner space of the serpentine-like tube assembly (FIG. 2) or the separate parallel tubes (FIG. 3) and the sea, whereby sea water serving as ballast may be introduced into, or evacuated from, said tubes by convenient means (not shown). Convenient pumping means or the like (not shown) may also be provided for pumping petroleum, by means of risers or conductor pipes such as 17 and 18 (FIG. 6), into tubes 6 of the caisson unit 2 during the petroleum extraction operations, with a view to stocking a predetermined quantity of extracted petroleum, or with a view to evacuating the stocked petroleum from tubes 6.

The tubular structure 4 of the platform further comprises a plurality of vertical hollow columns 9. Preferably four columns 9 are provided, to enhance the stability of the platform.

Figure 6:
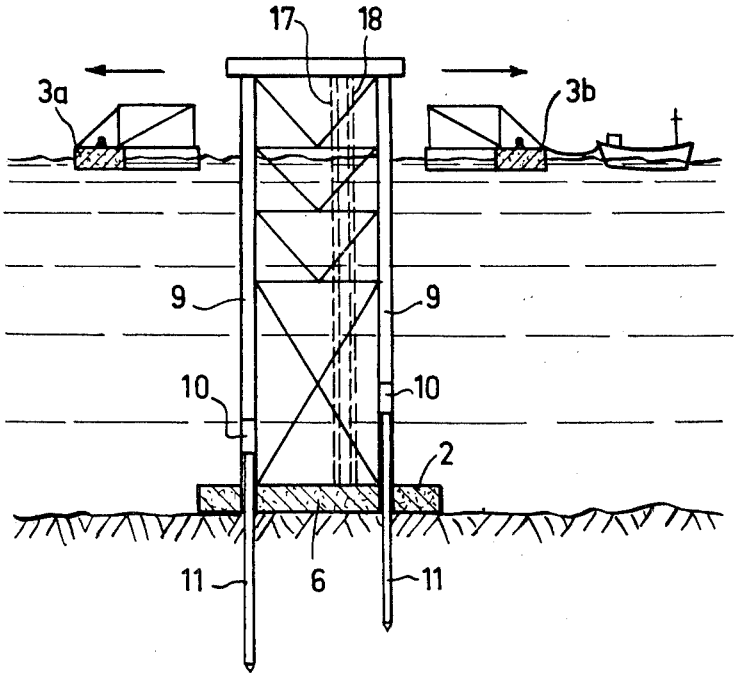
FIG. 6 shows the platform in its definitive condition, the pillars being driven into the submarine ground, and the floating unit being disassembled and about to be removed from the platform.

Columns 9 are integral with caisson unit 2 and with deck unit 5. They may contain each a slidable pillar 11 and a power hammer 10 actuated by convenient means known per se (not shown) whereby the platform may be firmly anchored to the submarine ground by driving the pillars 11 into said ground by means of said hammers 10 after touch-down of the caisson unit 2 at the desired site, as shown in FIG. 6. It will be understood that risers 9 are each open at its two ends so as to allow this anchoring operation to be carried out.

The floating unit 3 is constituted by two separably assembled elements 3*a*, 3*b* (FIG. 6) and has a substantially rectangular frame-like shape and is provided at its inwardly directed surfaces adapted to be directed, in the assembled state of the platform, toward the columns 9, which act as a guiding column for these floating units with gripping elements 12 e.g. in the form of rollers provided with a peripheral rubber layer and adapted to engage firmly said columns so as to hold floating unit 3 in any desired accurately centred position with respect to these columns.

Floating unit 3 is connected by adjustable holding elements such as cables 14 to the deck unit 5. Cables 14 are adapted to be wound up by winches 15 arranged on deck unit 5 and actuated preferably through electronic control units known per se, schematically indicated at 13, whereby the deck unit 5, tubular structure 4 and caisson unit 2 can be raised and lowered with respect to floating unit 3 in a predetermined, controlled manner.

On the construction site, i.e. on the site where the platform is assembled, the caisson unit 2 and the floating unit 3 are juxtaposed and attached to each other as shown in FIG. 1. The characteristics of the various elements of the platform are so selected that upon completion of the platform the floating line (or water line) is located between said caisson and floating units 2.3. Thus the entire platform floats in a perfectly stable manner.

When the construction of the platform is completed, at least four cables 14 unwound from winches 15, which are constant tension winches, connect the deck unit 5, on which said winches are mounted, to the floating unit 3.

Once completed, the platform leaves the construction site in the above described configuration, the floating unit 3 being located immediately above, are removably attached to the caisson unit 2.

It will be appreciated that in this configuration of the platform the equipment mounted on the deck unit, e.g. the winches 15, are located at a sufficient height above the water surface so as to be protected against any deleterious effects of water which might easily reach the platform if the same were towed in a position only slightly above the water surface, which is the case of the above mentioned known platform.

Figure 4:
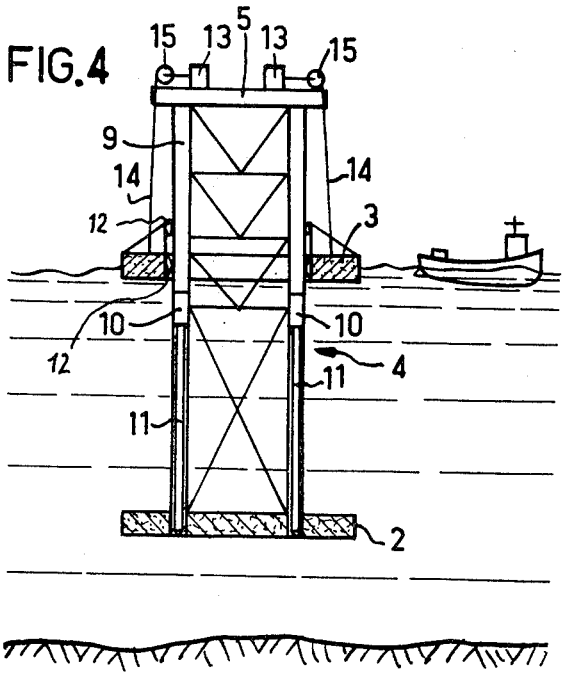
FIG. 4 shows the platform during its installation at the desired site at sea.
Figure 5:
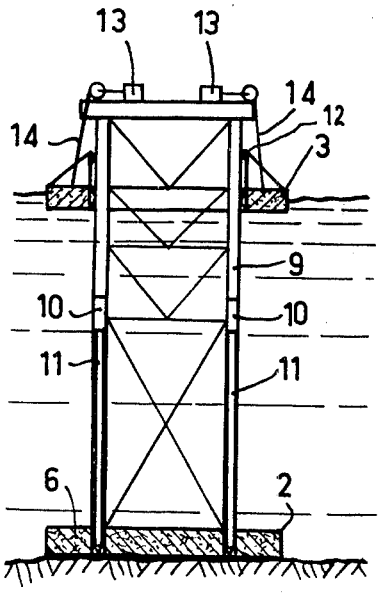
FIG. 5 shows the platform after touch-down of the caisson unit.

The platform is then towed until it reaches a site where the depth of the sea allows it to take its normal towing configuration wherein the caisson unit 2 is separated from the floating unit 3 and immersed to a certain depth, e.g. as shown in FIG. 4, thus lowering the centre of gravity of the entire platform structure and ensuring satisfactory floating stability of said platform unitl it reaches the desired offshore site where drilling or similar operating are to be performed.

During the towing of the platform in the configuration shown in FIG. 4, the winches 15, which have wound up a required length of cables 14 so as to allow the caisson unit 2 as well as the tubular structure 4 and the deck unit 5 integral therewith to move downwardly with respect to the floating unit 3, maintain the cables 14 under a constant tension in such a manner that the tower-like tubular structure 4 is maintained in a vertical position with respect to the floating unit 3. This result is achieved by the properly programmed electronic control devices 13 which are of the computer type.

It will be understood that, when the above mentioned site of appropriate depth of the sea is reached, the lowering of caisson unit is effected or assisted, if necessary, by introducing ballast into the tubular elements 6 of caisson unit 2 while automatically unwinding cables 14 from winches 15, as described herein before, until the center of gravity of the platform is located slightly below the floating line of floating unit 3, so that the positive buoyancy constituted by caisson unit 2, tubular structure 4 and deck unit 5 is reduced to a comparatively small value. Floating unit 3 of course does not receive any ballast, so that it remains at the surface of the water.

When the platform in this condition has been towed to a location corresponding approximately to the desired definitive offshore site, winches 15 are actuated once more to wind up a certain length of cables 14, while, if required, a supplementary amount of water is introduced into tubes 6 of caisson unit 2, so as to lower the assembly constituted by caisson unit 2, tubular structure 4 and deck unit 5 until said caisson unit reaches a location about 1.5m to 2.0m above the submarine ground. The platform is then positioned accurately over the desired site, whereafter more ballast water is introduced into tubes 6 of caisson unit 2 so that the above mentioned assembly 2, 4, 5 is still lowered until touch-down of the caisson unit 2 on the submarine ground. If desired, the power hammers 10 are then actuated to drive the pillars 11 into the submarine ground for firmly anchoring the platform. The hammers 10 are then removed by withdrawing them through the upper orifices of the inner spaces of guiding columns 9.

The floating unit 3 which, as mentioned above, is constituted by two parts 3*a*, 3*b* assembled by explosive bolts or similar removable elements, is then disassembled and removed from the platform, as shown in FIG. 6; once removed, said floating unit may be used in a similar consecutive sequence of operations of constructing, towing and anchoring at a desired offshore site another platform of the same kind. Cables 14 and even winches 15 and their accessories may also be recovered and reused.

The ballast introduced into tubes 6, which is constituted in the example described herein above by sea water may also be constituted by concrete or baryte slurry or the like. The water ballast used during towing and positioning the platform may also be replaced at a later time, as indicated above, by extracted petroleum to be stocked.

Figure 7:
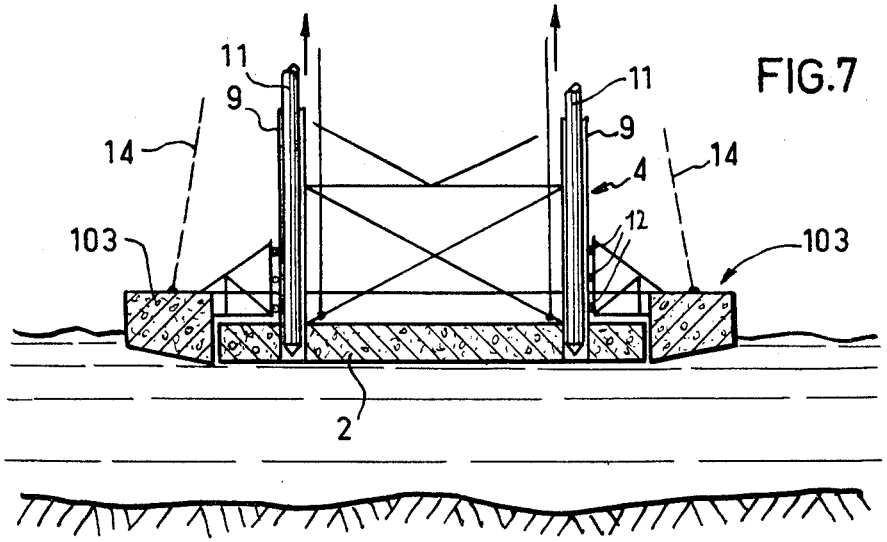
FIG. 7 shows another embodiment of the platform according to the invention.

FIG. 7 shows another embodiment of the platform according to the present invention. In this embodiment the floating unit 103 is not mounted on the top of the caisson unit 2, but surrounds the same, as shown. It will be appreciated that this arrangement provides for a substantially larger floating or supporting surface during the towing and lowering operations than the previously described embodiment does. Consequently the platform according to this embodiment exhibits still better stability properties than the platform shown in FIGS. 1, 4, 5 and 6.

What is claimed is:

1. A marine platform structure adapted to be towed towards a desired offshore site in an upright position, comprising:

a horizontal caisson until enclosing tubular elements and adapted to be placed onto the submarine ground at said offshore site;

means for selectively introducing into and evacuating from said tubular elements a fluid selected from the group consisting of air, water ballasting material and petroleum extracted from the submarine soil;

a substantially tubular tower-like structure having a plurality of parallel columns extending vertically upward from the upper side of said caisson unit, the lower end of said columns being rigidly fixed to said caisson unit;

a horizontal deck unit rigidly fixed to the upper ends of said columns;

a float unit comprising at least two detachably assembled float unit elements surrounding said tower-like structure, said float unit being vertically movable along said tower-like structure between a lowermost position wherein said float unit is located adjacent to said caisson unit and an uppermost position wherein said float unit is located in the vicinity of the underside of said deck unit, the buoyancy of said float unit being such that the latter always floats substantially on the surface of the sea, irrespective of the position of said float unit relative to said tower-like structure;

gripping means provided on said float unit for the prevention of any substantial lateral displacement of said float unit relative to said columns and for guiding said float unit during vertical displacement thereof along said columns by cooperation of said gripping means with said columns; and constant tension winches actuated by computer controlled electronic actuating means and mounted on said deck unit for respectively winding and unwinding said cables, the free ends of the latter being attached to said float unit for allowing said tower-like structure to move vertically with respect to said float unit while maintaining said cables under a constant predetermined tension when air or ballasting material is introduced into said hollow elements in said caisson unit for varying the buoyancy of said caisson unit.

2. The marine platform structure of claim 1, wherein said float unit is adapted to be placed onto said caisson unit when said float unit is in said lowermost position.

3. The marine platform structure of claim 1, wherein said float unit is adapted to surround said caisson unit when said float unit is in said lowermost position.

4. The marine platform structure of claim 1, wherein each one of said columns has an axially movable anchoring pillar arranged therein and a power hammer adapted to act on the associated anchoring pillar for driving the same into the submarine ground when the caisson unit has been lowered onto said ground, said hammers being removably mounted in said columns.

5. The marine platform structure of claim 1, wherein risers or conductor pipes are provided for connecting said caisson unit to said deck unit, said risers or conductor pipes being adapted to transfer fluid between said deck and caisson units.

* * * * *

UNITED STATES PATENT OFFICE
CERTIFICATE OF CORRECTION

Patent No. 4,118,942 Dated October 10, 1978

Inventor(s) Jean Liautaud

It is certified that error appears in the above-identified patent and that said Letters Patent are hereby corrected as shown below:

In the Abstract:

line 5: "and with" should be --with--.

Column 2, line 1 : "to" should be --is to--

Column 3, line 60: "centre" should be --center-- line 62: "unitl" should be --until--

Column 5, line 4 : "until" should be --unit--

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*